US005757336A

United States Patent [19]

Matsuoka

[11] Patent Number: 5,757,336

[45] Date of Patent: May 26, 1998

[54] ANTENNA UNIT

[75] Inventor: Manabu Matsuoka, Hino, Japan

[73] Assignee: SMK Corporation, Tokyo, Japan

[21] Appl. No.: 540,307

[22] Filed: Oct. 6, 1995

[30] Foreign Application Priority Data

Feb. 24, 1995 [JP] Japan ..... 7-061681

[51] Int. Cl.[6] ..... H01Q 1/36; H01Q 1/24

[52] U.S. Cl. ..... 343/895; 343/702; 343/749

[58] Field of Search ..... 343/895, 702, 343/906, 901, 749; H01Q 1/36, 1/24

[56] References Cited

U.S. PATENT DOCUMENTS 5,243,355 9/1993 Emmert et al. ..... 343/702
5,258,772 11/1993 Inanaga et al. ..... 343/702
5,526,005 6/1996 Koo ..... 343/841

*Primary Examiner*—Hoanganh T. Le
*Attorney, Agent, or Firm*—Pearne, Gordon, McCoy & Granger LLP

[57] ABSTRACT

An antenna unit having an antenna casing secured to a signal transmitting and receiving circuit. An antenna cover is slidably coupled to the antenna casing. An antenna element is provided inside the antenna cover. A coiled spring portion connects the antenna element to the signal transmitting and receiving circuit. The antenna element and the coiled spring portion are provided as one integral coil of wire. A clip is secured to the antenna cover and is engaged with a border between the antenna element and the coiled spring portion so as to keep the antenna element stationary relative to the antenna cover, thereby keeping the electrical characteristics of the antenna element constant, even when the antenna cover is slid relative to the antenna casing. The antenna element remains connected to the signal transmitting and receiving circuit at all times.

10 Claims, 3 Drawing Sheets

ANTENNA UNIT

BACKGROUND OF THE INVENTION

This invention relates to an antenna unit applied to a slave or child unit of a cordless telephone set unit or a portable telephone unit.

In a slave or child unit of a cordless telephone set or a portable telephone unit, its antenna (including an antenna cover and an antenna element) is accommodated in an antenna casing when the slave unit or the portable telephone unit is not in use, and when the unit is to be used, the antenna is pulled out for transmitting and receiving signals. Hence, the slidable antenna element must be kept electrically connected to the signal transmitting and receiving circuit at all times.

A conventional antenna unit of this type is as shown in FIG. 8. The antenna unit comprises: an antenna casing 102 in the form of a cylinder; an antenna cover 103 slidably inserted in the antenna casing 102; and an antenna element 141 provided inside the antenna cover 103. The antenna element 141 is soldered to one end of a coil spring 142, the other end of which is coupled to a metal part 105 which is electrically connected to a signal transmitting and receiving circuit. Hence, as the antenna cover 103 together with the antenna element 141 is slid, the coil spring is expanded or contracted to maintain the electrical contact at all times.

In order to slide the antenna cover 103 while providing clicking feeling, a plurality of engaging holes 102*a* are formed through the antenna casing 102, and a metal leaf spring 107 with a protrusion is secured to the outer cylindrical surface of the antenna cover 107, so that the protrusion of the leaf spring 107 is engaged with the engaging holes 102*a* successively. For the same purpose, a ball 171 and a spring 172, as shown in FIG. 9, may be employed.

The conventional antenna unit thus constructed suffers from the following difficulties:

As was described above, the antenna element 141 is soldered to the coil spring 142. Hence, the assembling of the antenna unit is rather complicated, and the resultant antenna unit is unstable in electrical characteristic.

Further, in case the metal leaf spring 107 is used for providing the click feeling when the antenna cover 103 is pushed in and pulled out of the antenna casing, the inner surface of the antenna casing 102 is gradually worn thereby, and, at worst, the protrusion of the leaf spring 107 may fail to engage with the engaging holes 102*a*. In case where the ball 171 and the spring 172 are employed, the antenna unit is increased in the number of components as much, and the assembling work of the antenna unit is complicated accordingly.

SUMMARY OF THE INVENTION

In view of the foregoing, an object of the invention is to provide an antenna unit for a slave or child unit of a cordless telephone set, a portable telephone unit, and so forth in which the antenna element is kept connected electrically to the signal transmitting and receiving circuit at all times, and even when the antenna element is slid, the electrical characteristic is maintained unchanged, and which can be assembled with ease.

The foregoing object and other objects of the invention have been achieved by the provision of an antenna unit comprising: an antenna casing which is secured to a body having a signal transmitting and receiving circuit; an antenna cover slidably coupled to the antenna casing; a one-piece coiled wire having an integral antenna element provided inside the antenna cover, and an integral circuit connecting means for electrically connecting the antenna element to the signal transmitting and receiving circuit; and locking means secured to the antenna cover and engaged with a boundary between the antenna element and the circuit connecting means.

Preferably, in the antenna unit, a pair of windows are formed in the side surface of the antenna cover through which the inside and outside of the antenna cover are communicated with each other, and the locking means is made up of a clip which has a pair of engaging portions inserted into the antenna cover through the windows to engage with the boundary between the antenna element and the circuit connecting means. Furthermore, in the antenna unit, the clip is formed into the U-shaped having an opening, and the engaging portions are formed as protrusions which are extended inwardly into the opening of the clip.

Moreover, preferably, in the antenna unit, the clip has a protrusion on the outer periphery in such a manner that it is extended over the outer cylindrical surface of the antenna cover, and engaging holes are formed in the side surface of the antenna casing, with which the protrusion is elastically engageable. In addition, in the antenna unit, the antenna cover is made of an elastic material, and the clip is made of a lubricative material harder than the material of the antenna cover.

In the antenna unit of the invention, the antenna element and the circuit connecting means are provided as integral portions of the one-piece coiled wire. This feature makes it possible to assemble the antenna unit without soldering work. That is, the antenna unit can be assembled with ease, and further it is improved in electrical characteristic when compared with the conventional antenna unit. Furthermore, in the antenna unit, the locking means is provided which is secured to the antenna cover and is engaged with the boundary between the antenna element and the circuit connecting means. Hence, when the antenna cover together with the antenna element is slid, only the circuit connecting means is expanded or contracted, and the antenna element is maintained unchanged in length and shape. That is, the antenna is prevented from being changed in sensitivity.

In the antenna unit, the windows are formed in the side surface of the antenna cover through which the inside and outside of the antenna cover are communicated with each other, and the locking means is formed as the clip having the engaging portions which are inserted into the antenna cover through the windows to engage with the boundary between the antenna element and the circuit connecting means. Hence, the boundary between the antenna element and the circuit connecting mean can be readily secured to the antenna cover with the clip inserted in the latter. Thus, the antenna unit can be assembled with ease.

The antenna cover and the clip may be formed by using different materials. For instance, the antenna cover may be formed by using an elastic material, and the clip may be formed by using a lubricative material harder than the material of the antenna cover.

In the antenna unit, the clip is U-shaped having an opening, and the engaging portions are the protrusions which are extended inside the opening from the clip. Hence, merely by fitting the clip crosswise or transversely with respect to the antenna cover, the boundary between the antennal element and the circuit connecting means can be secured to the antenna cover. Thus, the antenna unit can be readily assembled.

Furthermore, in the antenna unit, the clip has the small protrusion on the outer periphery in such a manner that it is extended over the outer cylindrical surface of the antenna cover, and the engaging holes are formed in the side surface of the antenna casing which are elastically engaged with the small protrusion. Hence, when the antenna cover is slid, the protrusion is engaged with the engaging holes to provide the click feeling, and the antenna unit capable of providing the click feeling can be assembled with ease.

Moreover, in the antenna unit, the antenna cover is made of an elastic material, and the clip is made of a lubricative material harder than the material of the antenna cover. This feature prevents the antenna cover from being broken, and decreases the wear of the protrusion of the clip, so that the antenna unit is increased in service life as much.

The nature, utility and principle of the invention will be more clearly understood from the following detailed description and the appended claims when read in conjunction with the accompanying drawings, in which like parts are designated by like reference numerals or characters.

DETAILED DESCRIPTION OF THE INVENTION

An antenna unit, which constitutes a preferred embodiment of the invention, will be described with reference to the accompanying drawings.

Figure 1:
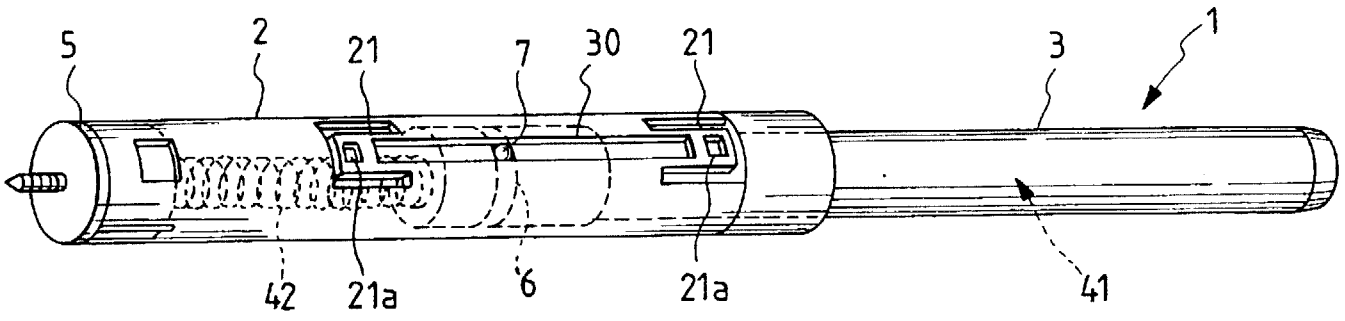
FIG. 1 is a perspective view showing an antenna unit, which constitutes a preferred embodiment of the invention.

The antenna unit, as shown in FIG. 1, includes an antenna 1 which comprises an antenna cover 3 in the form of a cylindrical pipe; and an antenna element 41 provided inside the antenna cover 3. Thus, the antenna 1 is in the form of a cylinder as a whole. The antenna 1 is slidably accommodated in an antenna casing 2 which is secured to a body of a telephone unit (not shown).

Figure 2:
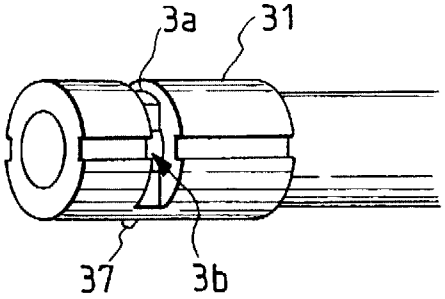
FIG. 2 is a perspective view showing a slide section of an antenna cover in the antenna unit illustrated in FIG. 1.
Figure 3:
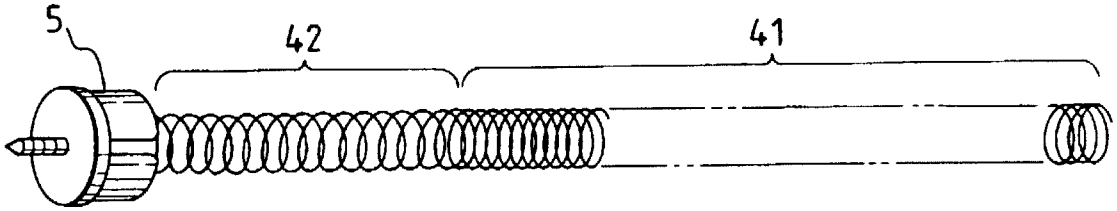
FIG. 3 is a perspective view showing an antenna element, a coil spring, and a metal fitting in the antenna unit illustrated in FIG. 1.
Figure 4:
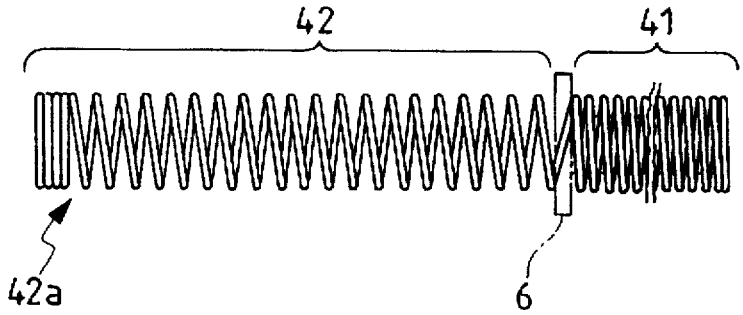
FIG. 4 is a side view of the antenna element and the coil spring shown in FIG. 3.

As shown in FIG. 2, one end portion of the antenna cover 3 has an opening through which the antenna element 41 is insertable into the antenna cover 3, and it is formed into a slide section 31 which is slid in the antenna casing 2. The antenna element 41, as shown in FIG. 3 or 4, is integral with a coiled spring portion 42 (corresponding to circuit connecting means). That is, a one-piece coiled wire made of a hard steel wire (SWC) 0.3 mm in diameter forms the integral antenna element 41 and the integral coiled spring portion 42. More specifically, the antenna element 41 is 5.4 mm in effective diameter and 0.6 mm in pitch, and the coiled spring portion 42 is 5 mm in effective diameter and 1.25 mm in pitch.

The end 42*a* of the coil spring 42 is connected to a metal fitting 5, which is fitted in the end portion of the antenna casing 2. The metal fitting 5 is screwed in the telephone unit body, so that the antenna casing 2 is secured to the telephone unit body while the coil spring 42 is electrically connected to the signal transmitting and receiving circuit.

Figure 5:
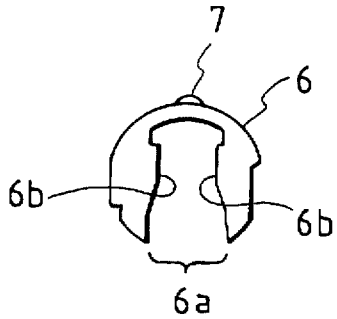
FIG. 5 is a front view of a clip in the antenna unit shown in FIG. 1.
Figure 6:
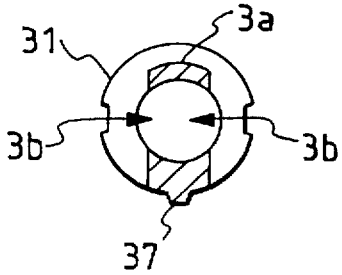
FIG. 6 is a cross sectional view of the antenna cover shown in FIG. 2.

On the other hand, the antenna element 41 is inserted into the antenna cover 3, and the boundary between the antenna element 41 and the coiled spring portion 42 is locked to the antenna cover 3 with a clip 6 (corresponding to locking means). As shown in FIG. 5, the clip 6 is U-shaped having a pair of legs which define an opening 6*a* therebetween. The clip 6 is engaged with a mounting groove 3*a* formed in the side surface of the slide section 31 of the antenna cover 3.

A pair of windows 3*b* and 3*b* are formed in the mounting groove 3*a* of the slide section 31 of the antenna cover 3 in such a manner that the inside and outside of the antenna cover are communicated with each other through those windows 3*b*. The clip 6, which is U-shaped as described above, has a pair of protrusions 6*b* and 6*b* (corresponding to engaging portions) which are extended or protruded into the opening 6*a* from the pair of legs. Those protrusions 6*b* and 6*b* are engaged through the windows 3*b* and 3*b* with the boundary between the antenna element 41 and the coiled spring portion 42.

Figure 7:
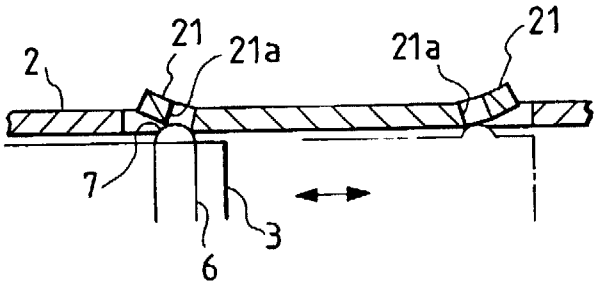
FIG. 7 is a longitudinal sectional view of the antenna casing shown in FIG. 1.
Figure 8:
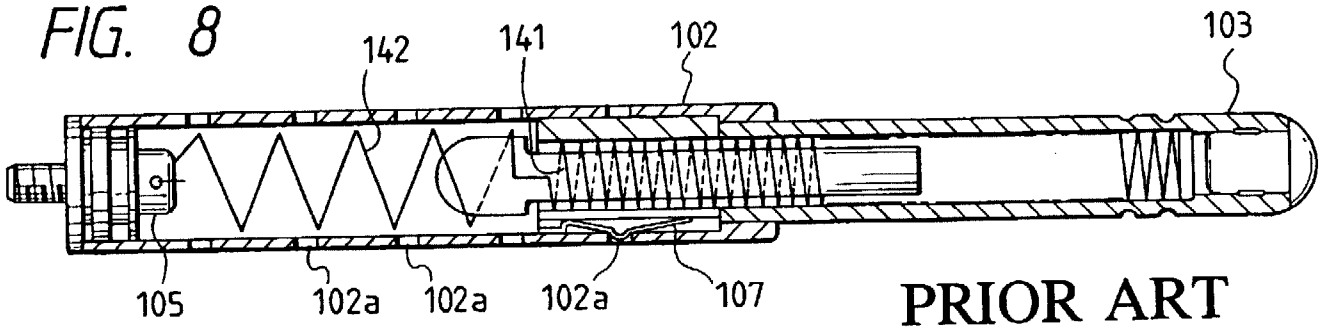
FIG. 8 PRIOR ART
FIG. 8 is a longitudinal sectional view of an example of a conventional antenna unit.
Figure 9:
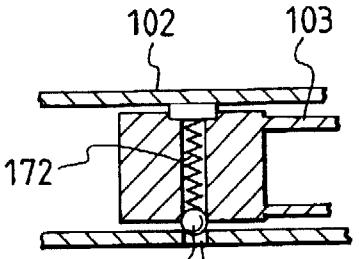
FIG. 9 PRIOR ART
FIG. 9 is a longitudinal sectional view showing a part of another example of the conventional antenna unit.

As shown in FIG. 7, the clip 6 has a small protrusion 7 on the outer periphery thereof in such a manner that the small protrusion 7 is slightly extended over the outer cylindrical surface of the antenna cover 3. Another small protrusion 37 is formed on the outer cylindrical surface of the antenna cover 3 in such a manner that it is diametrically opposite to the aforementioned small protrusion 7 of the clip 6. Instead of those small protrusions, a plurality of small protrusions may be formed on the clip 6. A plurality of engaging holes 21*a* are formed in the antenna casing 2 at predetermined intervals in the direction of slide of the antenna cover 3, with which the small protrusions 7 and 37 are elastically engageable. As shown in FIG. 1 or 7, a plurality of U-shaped cuts are formed in the antenna casing 2 to form a plurality of mold springs 21. The aforementioned engaging holes 21*a* are formed in the mold spring 21 thus formed. In the embodiment shown in FIG. 1, two engaging holes 21*a* are formed for engagement with the protrusion 7, and an axially elongated slit 30 is formed through the antenna casing 2 so as to be located between and aligned with the engaging holes 21*a*, whereby the protrusion 7 disengaged from one of the engaging holes 21*a* is slidably guided by the axially elongated slit 30 to engage with the other. The axially elongated slit 30 may be considered as the engaging hole of the invention.

The antenna casing 2 having the mold springs 21 is formed by using a material such as PPO (polyphenylene oxide) high in wear resistance. In order to prevent the antenna cover 3 from being broken when pulled out of the antenna casing 2, the antenna cover 3 is formed by using an elastic material of a synthetic rubber group such as for instance elastomer. In order to prevent the wear of the small protrusion 7 of the clip 6, the clip 6 is made of a hard lubricative material such as polyacetal.

In assembling the antenna unit thus constructed, no soldering work is required, because the antenna element 41 and the coiled spring portion 42 are provided as a one-piece member. Merely by fitting the clip 6 in the mounting groove 3*a*, the boundary between the antenna element 41 and the coiled spring portion 42 can be secured to the antenna cover 3. Provision of the mold springs 21, which are parts of the antenna casing 2, and the small protrusion 7 of the clip 6 makes it possible to reduce the number of components, and to assemble the antenna unit readily.

The antenna unit is used as follows: The operator holds the end portion of the antenna cover 3 (i.e., the antenna 1), and pulls it out of the antenna casing 2, or pushes it back into the antenna casing 2. When the antenna cover 3 (i.e., the antenna 1) is pulled out of the antenna casing 2 or pushed back into the latter, the small protrusion 7 on the side of the antenna cover 3 is elastically engaged with the engaging holes 21*a* on the side of the antenna casing 2; that is, the antenna cover 3 is moved in a clicking mode. In the antenna unit of the invention, the clip 6 having the small protrusion 7, and the antenna casing 2 having the engaging holes 21*a* are made of the above-described materials, and, unlike the conventional antenna unit, no metal leaf spring is employed. Hence, the antenna casing 2 is less worn, and the performance of clicking of the antenna cover 3 (i.e., the antenna 1) in and out of the antenna casing 2 is maintained for a long time.

The boundary between the antenna element 41 and the coiled spring portion 42 is supported by the clip 6. Hence, when the antenna cover 3 together with the antenna element 41 is slid, only the coiled spring portion 42 is expanded or contracted while the antenna element 41 is maintained stationary with respect to the antenna cover 3. Therefore, the antenna 1 is prevented from being changed in sensitivity. In addition, the assembling work of the antenna unit requires no soldering work, so that the resultant antenna unit is stabilized in impedance, and improved in electrical characteristic.

In the antenna unit of the invention, the antenna element and the circuit connecting means are provided as the one-piece coil made of a wire. Hence, the assembling work of the antenna unit requires no soldering work. Accordingly, the antenna unit can be readily assembled, and it is improved in electrical characteristic. In addition, the antenna unit includes the locking means which is secured to the antenna cover and is engaged with the boundary between the antenna element and the circuit connecting means. Hence, when the antenna cover together with the antenna element is slid, only the circuit connecting means is expanded or contracted, and the antenna element is maintained stationary with respect to the antenna cover. That is, the antenna is maintained unchanged in sensitivity at all times.

In the antenna unit, the windows are formed in the side surface of the antenna cover through which the inside and outside of the antenna cover are communicated with each other, and the clip is provided which has the engaging portions which are inserted into the antenna cover through the windows to engage with the boundary between the antenna element and the circuit connecting means. Hence, the boundary between the antenna element and the circuit connecting mean can be readily secured to the antenna cover with the clip inserted in the latter. Thus, the antenna unit can be assembled with ease. The antenna cover and the clip may be formed by using different materials; that is, the clip may be formed by using a lubricative material harder than the material of the antenna cover.

In the antenna unit, the clip is U-shaped having the pair of legs which define the opening, and the clip has the protrusions which are extended inside the opening from the legs. Hence, merely by fitting the clip crosswise or transversely in the antenna cover, the boundary between the antennal element and the circuit connecting means can be secured to the antenna cover. This means that the antenna unit can be readily assembled.

Furthermore, in the antenna unit, the clip has the small protrusion on the outer periphery in such a manner that it is extended over the outer cylindrical surface of the antenna cover, and the engaging holes are formed in the side surface of the antenna casing which are elastically engaged with the small protrusion. Hence, when the antenna cover is slid, the small protrusion is engaged with the engaging holes in a clicking mode; that is, the antenna cover can be clicked in and out of the antenna casing. Thus, the antenna unit can be assembled with ease.

Moreover, in the antenna unit, the antenna cover is made of an elastic material, and the clip is made of a lubricative material harder than the material of the antenna cover. This feature prevents the antenna cover from being broken, and decreases the wear of the small protrusion of the clip, thus increasing the service life of the antenna unit as much.

While there has been described in connection with the preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An antenna unit for a signal transmitting and receiving circuit in a body, said antenna unit comprising:

an antenna casing adapted to be secured to said body;

an antenna cover slidably coupled to said antenna casing, a pair of windows are formed in a side surface of said antenna cover through which the inside and outside of said antenna cover communicate with each other;

a one-piece coiled wire including an integral antenna element provided inside said antenna cover, and an integral circuit connecting means for connecting said antenna element to said signal transmitting and receiving circuit; and locking means secured to said antenna cover and engaged with a boundary between said antenna element and said circuit connecting means, said locking means includes a clip at least partially inserted into said antenna cover through said windows to engage with said boundary between said antenna element and said circuit connecting means.

2. An antenna unit as claimed in claim 1, wherein:

said clip is U-shaped and has a pair of legs defining an opening therebetween, and said clip includes protrusions extending inwardly into said opening from said legs.

3. An antenna unit as claimed in claim 1, wherein:

said clip has a protrusion on an outer periphery thereof;

said protrusion is protruded over an outer cylindrical surface of said antenna cover; and engaging holes are formed in the side surface of said antenna casing for elastically receiving said protrusion.

4. An antenna unit as claimed in claim 3, wherein:

said antenna cover is made of an elastic material; and said clip is made of a lubricative material harder than said material of said antenna cover.

5. An antenna unit as claimed in claim 4, wherein said locking means prohibits an elastic deformation of said circuit connecting means from being transmitted to said antenna element.

6. An antenna unit for a signal transmitting and receiving circuit in a body, said antenna unit comprising:

an antenna casing adapted to be secured to said body;

an antenna cover slidably coupled to said antenna casing to define a hollow internal core in cooperation with said antenna casing;

a one-piece coiled wire installed in said hollow internal core and electrically connected to said signal transmitting and receiving circuit; and a clip fitted transversely with respect to said antenna cover and engaged with said one-piece coiled wire for making a portion of said one-piece coiled wire stationary with respect to said antenna cover while permitting an elastic deformation of the other portion of said one-piece coiled wire.

7. An antenna unit as claimed in claim 6, further comprising:

a groove formed in said antenna cover for receiving said clip therein, said groove being formed into a U-shape as viewed in a plane orthogonal to a longitudinal axis of said hollow internal core.

8. An antenna unit as claimed in claim 6, further comprising:

a protrusion provided on said clip and radially outwardly protruded with respect to said antenna cover;

a plurality of engaging holes formed through said antenna casing for engagement with said protrusion.

9. An antenna unit as claimed in claim 8, wherein said engaging holes includes a pair of holes each formed through a mold spring provided on said antenna casing by a U-shaped cut, and an elongated hole located between and in alignment with said pair of holes.

10. An antenna unit as claimed in claim 6, wherein said one-piece coiled wire has an integral large diameter portion having a first effective diameter and corresponding to the stationary portion of said one-piece coiled wire, and an integral small diameter portion having a second effective diameter smaller than said first effective diameter and corresponding to the deformable portion of said one-piece coiled wire.

* * * * *

UNITED STATES PATENT AND TRADEMARK OFFICE

CERTIFICATE OF CORRECTION

PATENT NO. : 5,757,336

DATED : May 26, 1998

INVENTOR(S) : Manabu Matsuoka

It is certified that error appears in the above-identified patent and that said Letters Patent is hereby corrected as shown below:

Title page, Item [75], delete "Hino, Japan" and insert --Tokyo, Japan--.

Signed and Sealed this

Fifteenth Day of September, 1998

*Attest:*

Bruce Lehman

BRUCE LEHMAN

*Attesting Officer*

*Commissioner of Patents and Trademarks*